United States Patent [19]

Krueger

[11] 4,068,200

[45] Jan. 10, 1978

[54] COMBINATION COVER INTERLOCK AND TRIP ACTUATOR

[75] Inventor: Keith T. Krueger, Bellefontaine, Ohio

[73] Assignee: Gould Inc., Rolling Meadows, Ill.

[21] Appl. No.: 681,244

[22] Filed: Apr. 28, 1976

[51] Int. Cl.[2] ..... H01H 9/22

[52] U.S. Cl. ..... 335/172; 200/50 A

[58] Field of Search ..... 335/172, 173, 174, 175, 335/176, 25, 8, 9, 10; 200/50 A

[56] References Cited

U.S. PATENT DOCUMENTS

| | | | |
|---|---|---|---|
| 3,030,470 | 4/1962 | Hargreaves | 200/50 A |
| 3,781,728 | 12/1973 | Grunert et al. | 200/50 A |
| 4,000,478 | 12/1976 | Jencks et al. | 200/50 A |

*Primary Examiner*—Harold Broome

*Attorney, Agent, or Firm*—Ostrolenk, Faber, Gerb & Soffen

[57] ABSTRACT

A multi-pole molded case circuit breaker is provided with an interlock, including an actuator, that automatically operates a common trip bar to trip position when the cover of the molded case is open. With the cover closed, the actuator is accessible for a twisting operation which also operates the trip bar to trip position.

6 Claims, 15 Drawing Figures

65a
110

110
65a
18a
6
7
8

110
9

65a
18a
114
110

114
110

COMBINATION COVER INTERLOCK AND TRIP ACTUATOR

This invention relates to molded case circuit breakers in general and more particularly relates to a single actuator which functions as a manual tripping means and also functions as a cover interlock.

With increased utilization of relatively high voltages and/or high capacity power sources, the importance of safety features for circuit breakers has become more significant. It is especially important that the cooperating contacts of electrical switches be open when they are being serviced.

In this connection molded case circuit breakers have often been mounted in metal boxes with the combination being interlocked so that the box cover cannot be opened when the circuit breaker is closed. However, this has only been a partial solution for safety requirements in connection with servicing of circuit breakers.

This, in accordance with teachings of the instant invention, a molded case circuit breaker is provided with an interlock so constructed that when the cover of the molded housing is removed the circuit breaker is automatically tripped and cannot be reset until the cover is closed. This interlock is so constructed that the actuator therefore is also accessible from outside of the housing even with the cover thereof closed, and operation of this member is effective to trip the circuit breaker for test purposes.

Accordingly, a primary object of the instant invention is to provide a novel cover interlock for a molded case circuit breaker.

Another object is to provide a circuit breaker having simplified cover interlock means and a manual trip means.

Still another object is to provide a circuit breaker of this type in which a single actuator is used as a cover interlock and as a test trip element.

A further object is to provide a circuit breaker of this type having a depressible actuator which acts as a cover interlock and which is pivotable for test trip purposes.

These objects as well as other objects of this invention shall become readily apparent after reading the following description of the accompanying drawings in which.

Figures 5, 6, 7, 8, 9:
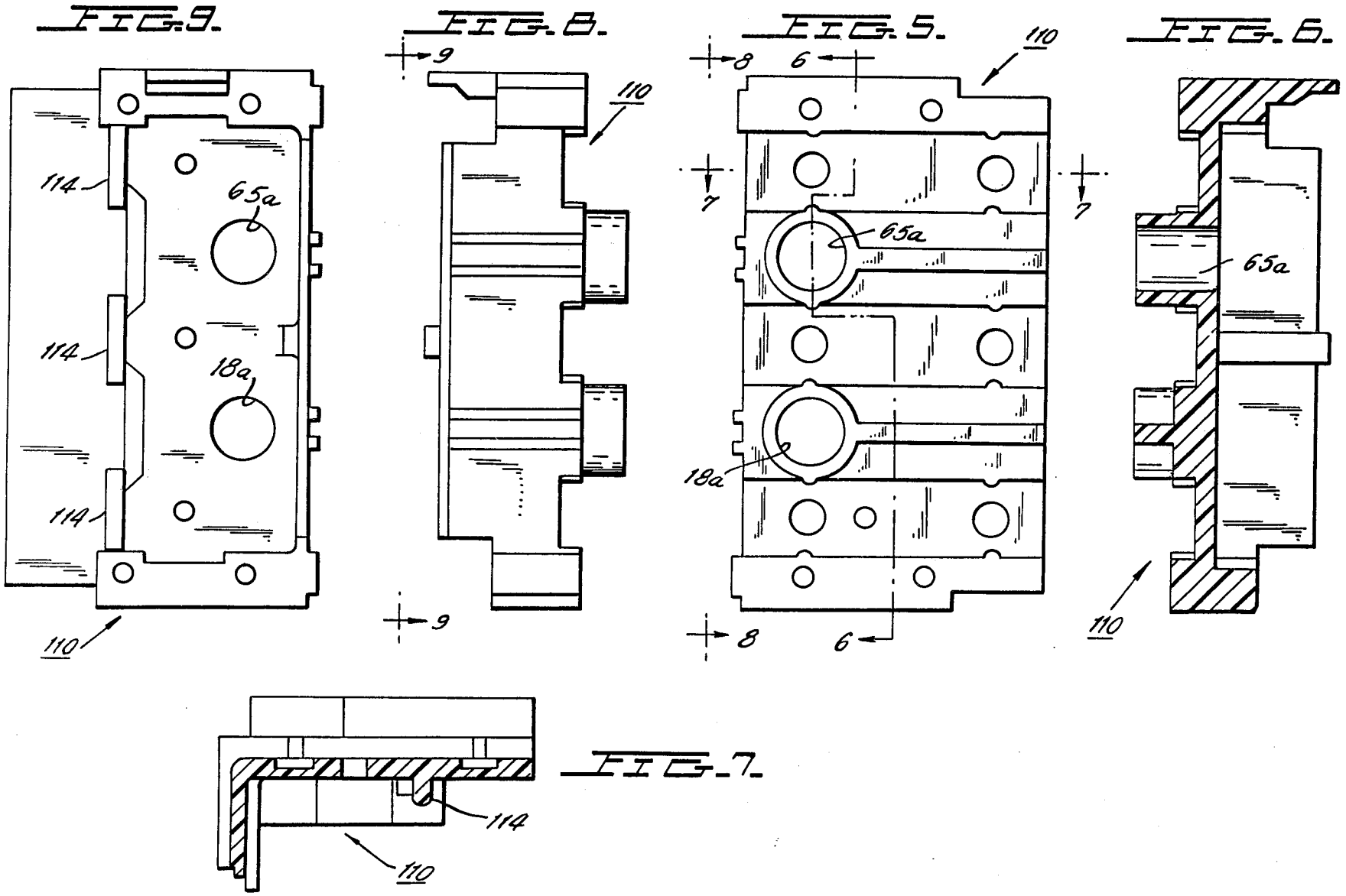
FIG. 5 is a plan view of the auxiliary cover for the trip mechanism chamber.

FIGS. 6 and 7 are cross-sections taken through the respective line 6—6 and 7—7 of FIG. 5 looking in the directions of the respective arrows 6—6 and 7—7.

FIG. 8 is an end view of the auxiliary cover looking in the direction of arrows 8—8 of FIG. 5.

FIG. 9 is a rear view of the auxiliary cover looking in the direction of arrows 9—9 of FIG. 8.

Figures 10, 11, 12, 13, 14, 15:
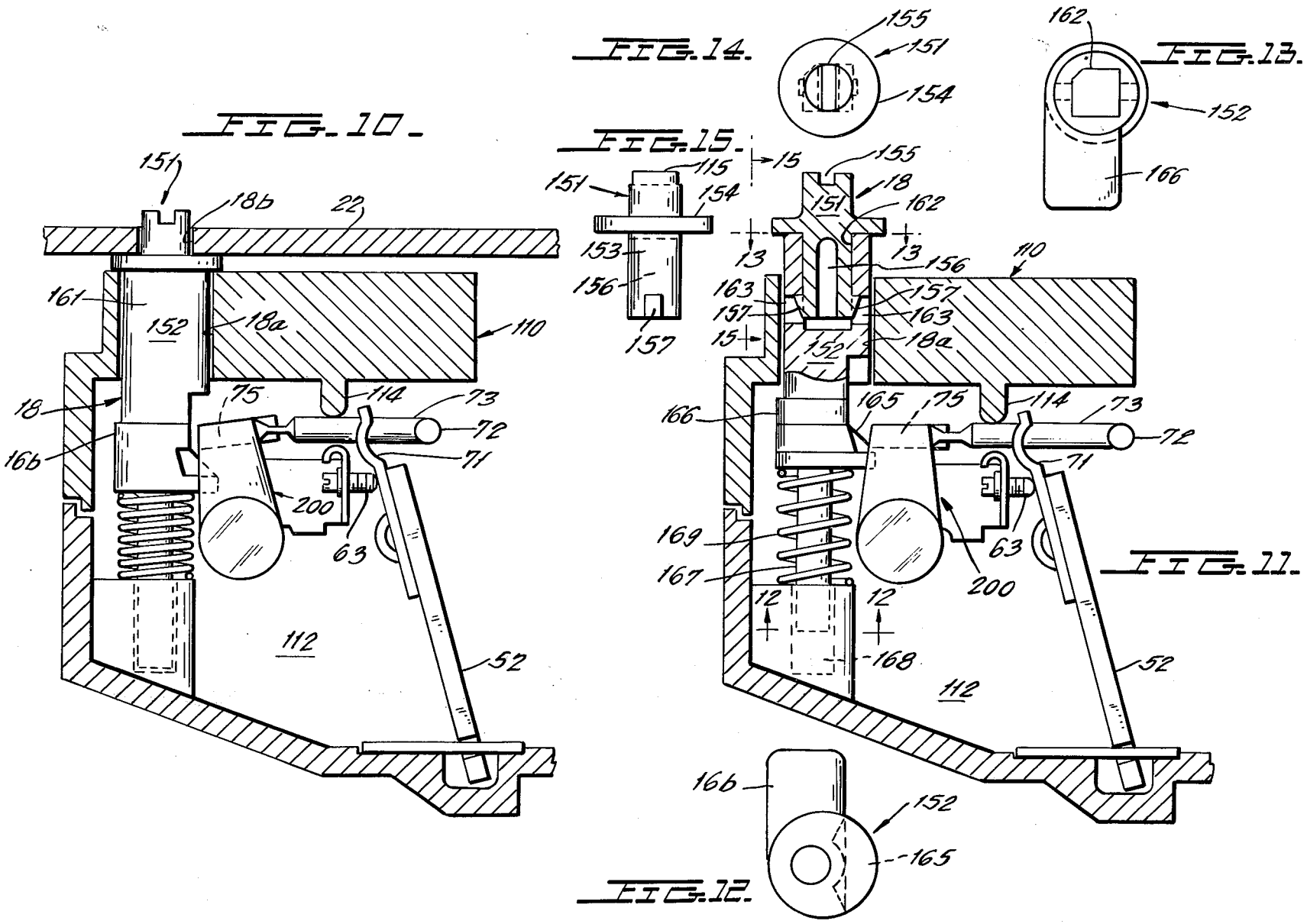

FIGS. 10 and 11 are fragmentary side elevations showing the relationship between selected elements of the trip unit. In FIG. 10 the common trip bar is in its normal or reset position and FIG. 11 the bar is in the tripped position having been operated thereto by removal of the main cover.

FIG. 12 is a rear elevation of the common trip member looking in the direction of arrows 12—12 of FIG. 11.

FIG. 13 is a front elevation of the common trip member looking in the direction of arrows 13—13 of FIG. 11.

FIG. 14 is a cross-section of the adjustment knob taken through lines 13—13 of FIG. 11 looking in the direction of arrows 13—13.

FIG. 15 is a side elevation of the adjustment knob looking in the direction of arrows 15—15 of FIG. 11.

Figure 4:
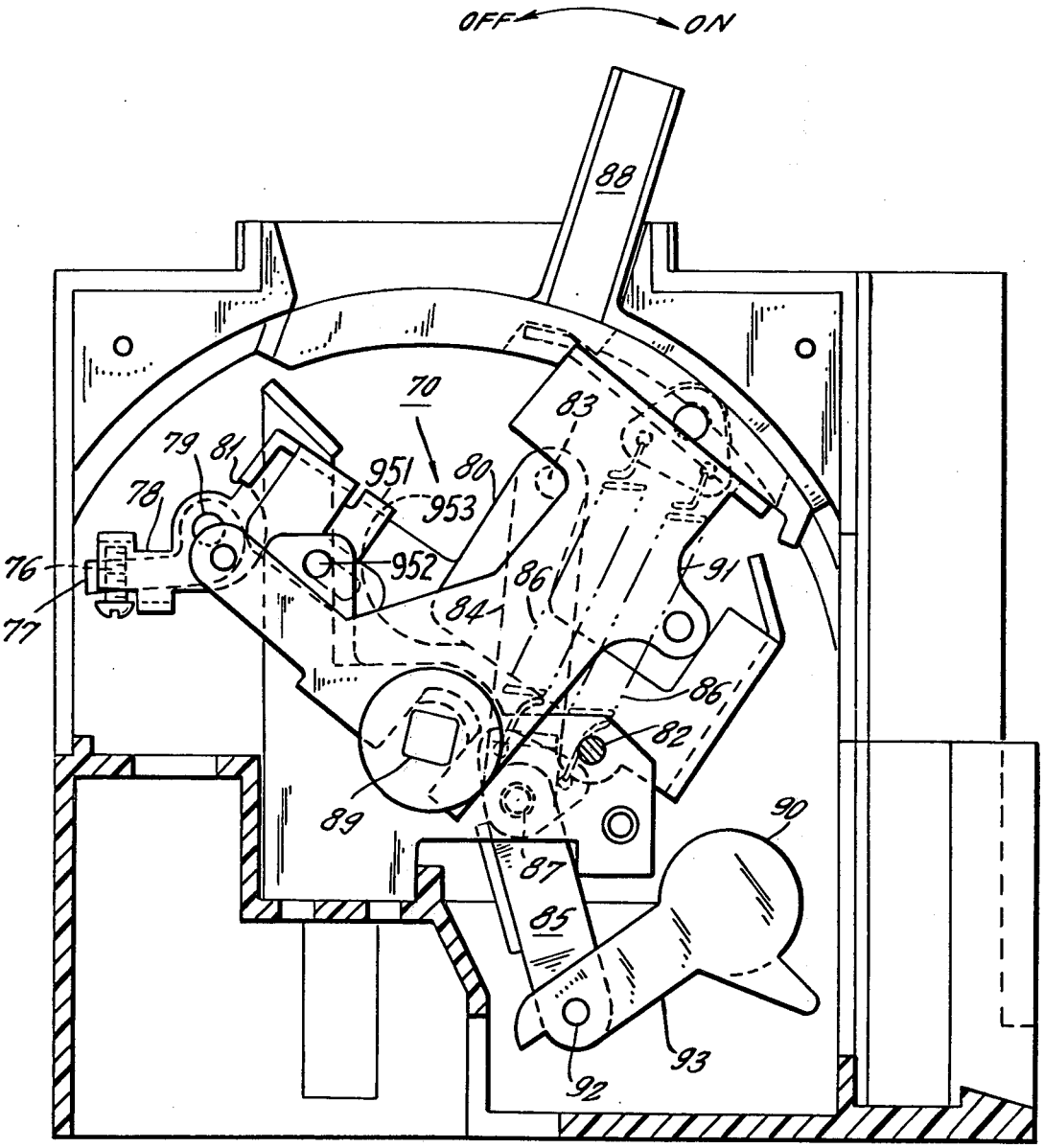
FIG. 4 is a cross-section taken through line 4—4 of FIG. 1 looking in the direction of arrows 4—4 and showing the elements of the circuit breaker manual operating mechanism in contact closed position.

Now referring to the Figures. Unitized Combination motor starter 20 includes a molded insulating housing consisting of base 21 and removable shallow front cover 22 secured in operative position by screws 19. Cover 22 includes longitudinally extending parallel ribs that mate with similar ribs 24, 25 26 in base 21 to form elongated parallel compartments. Three of these compartments have current carrying elements identical to those illustrated in the right hand portion of FIG. 2, and constitute a pole of the three pole circuit breaker portion 59 of starter 20. Removable side cover 67 is provided for the compartment which encloses spring powered trip free contact operating mechanism 70 of FIG. 4.

Figure 2:
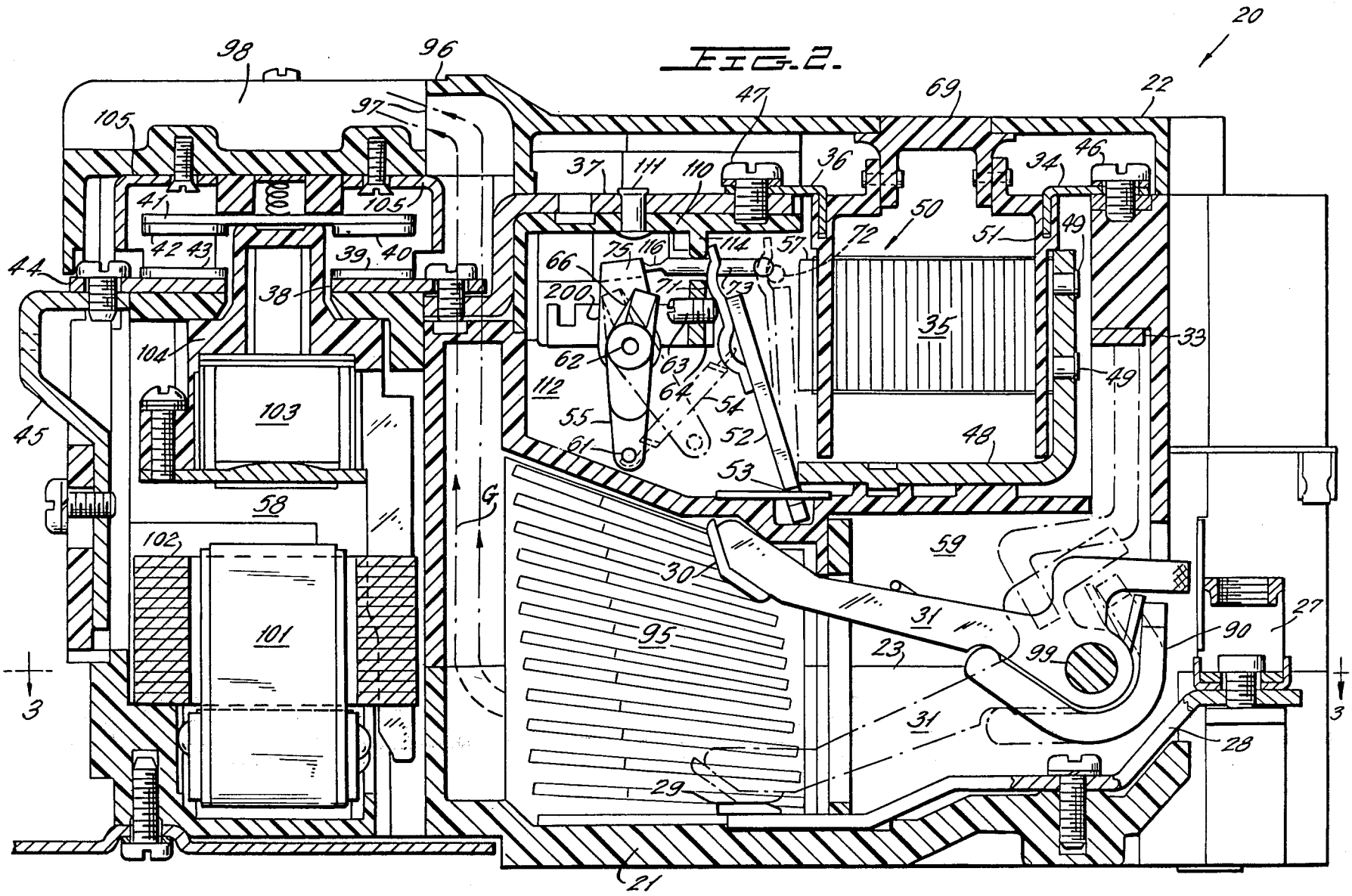
FIG. 2 is a cross-section taken through line 2—2 of FIG. 1 looking in the direction of arrows 2—2 and showing the elements of one pole unit.
Figure 3:
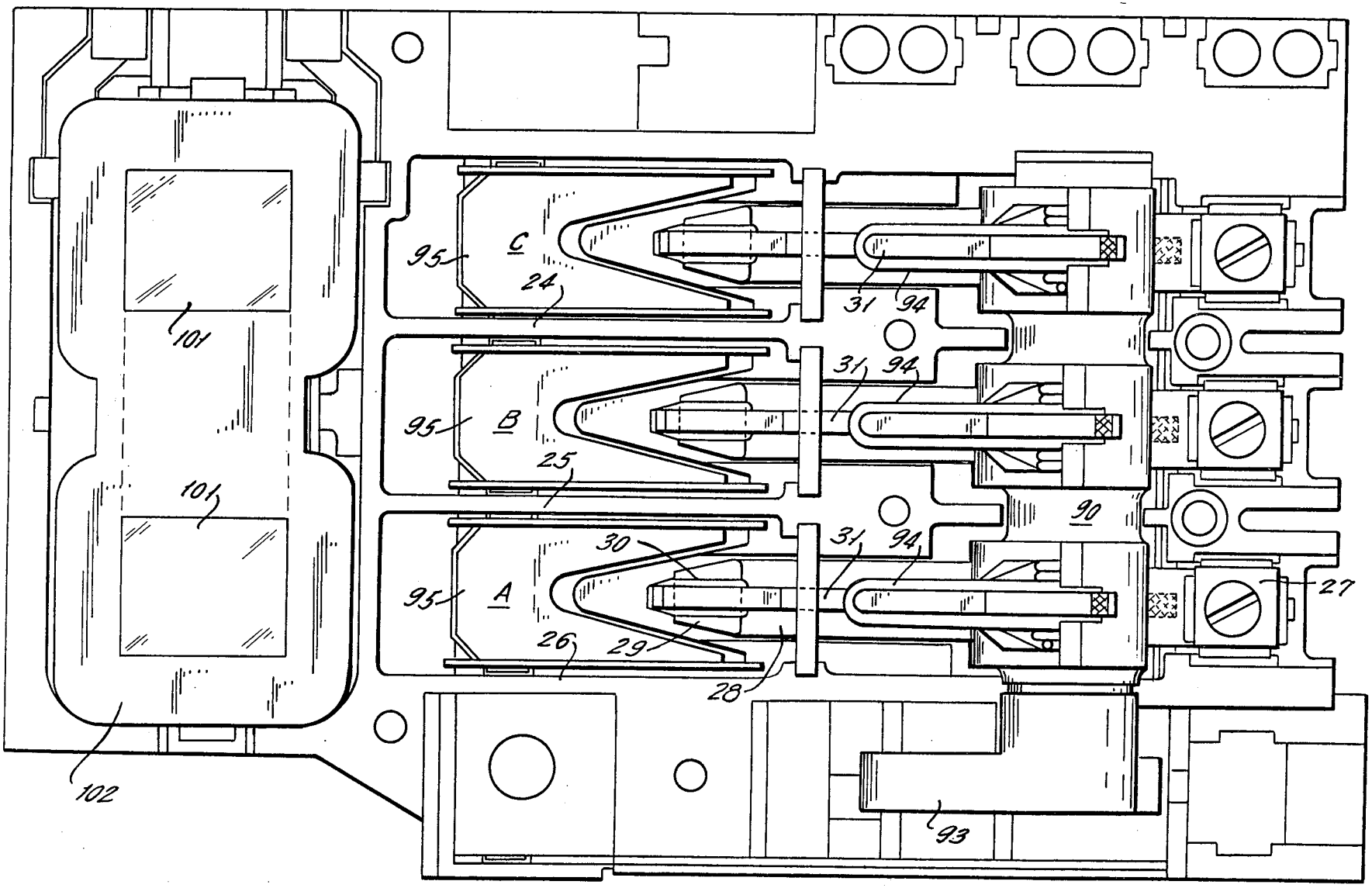
FIG. 3 is a cross-section taken through lines 3—3 of FIG. 2 with the circuit breaker contacts closed, looking in the direction of arrows 3—3.

The current carrying path for each pole A, B, C of starter 20 is identical so that only one of these paths shall be described with particular reference to FIG. 2. This current path includes wire grip 27 at one end of line terminal strap 28, strap 28, stationary contact 29 at the other end of strap 28, movable contact 30 at one end of movable contact arm 31, arm 31, flexible braid 32 at the other end of arm 31, U-shaped strap 33, coil terminal 34, coil 35, the other terminal 36 for coil 35, conducting straps 37 and 38, stationary contact 39 of electromagnetic contactor portion 58 of starter 20, movable contactor contact 40, conducting bridge 41, movable contactor contact 42, stationary contactor contact 43, conductig strap 44, and load terminal strap 45. The latter is constructed so as to be connectible directly to a load or to be connectible to a load through a conventional overload relay (not shown).

Figure 1:
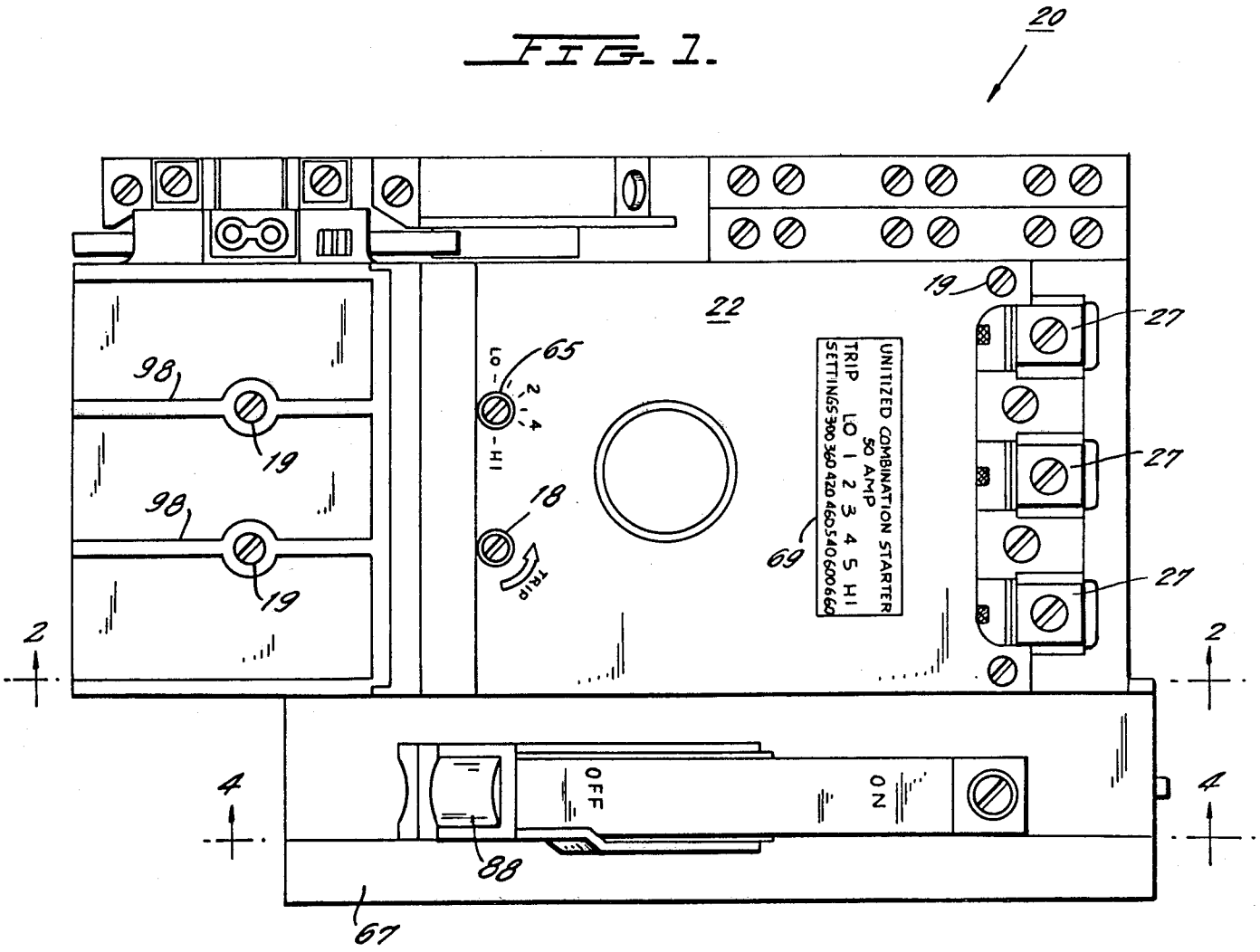
FIG. 1 is a plan view of a unitized combination motor starter including trip bar means constructed in accordance with teachings of the instant invention.

Coil 35 is part of circuit breaker calibrating assembly 50 removable and replaceable from the front of starter 20 after front cover 21 is removed. The calibrating assemblies 50 of all three poles may be individual units or they may be connected to a common insulating member 69 (FIG. 1) so that all three assemblies 50 must be removed as a unit.

Each subassembly 50 is electrically and mechanically secured in operative position by a pair of screws 46, 47 that are accessible when cover 22 is removed from base 21. Coil 35 is wound about bobbin 57 that surrounds one leg of stationary C-shaped magnetic frame 48. The latter is secured by rivets 49, 49 to insulator 51 having terminal 34 and bobbin 57 mounted thereto. The magnetic fame also included movable armature 52 which is pivotally mounted at its lower end in the region indicated by reference numeral 53 so that the upper end of armature 52 may move toward and away from stationary frame portion 48. Coiled tension spring 54 is connected to pin formation 61 at the edge of adjusting bar 55 remote from its pivot provided by pins 62. Thus, spring 54 biases the forward end of armature 52 away from magnetic frame 48.

The air gap adjutment between armature 52 and frame 48 is set by screw 63 which is threadedly mounted to transverse member 64. A cam (not shown) at the rear of pivotable adjusting control 65 engages extension 66 of member 55 to adjust the tension on all three springs 54 without changing the air gaps between any of the armatures 52 and their associated stationary frame sections 48. Control 65 extends through and is journalled for movement within aperture 65a of auxiliary cover 110 (FIG. 5). As will be explained hereinafter in greater detail, turn-to-trip control 18 extends through and is journalled for movement within aperture 18a of auxilliary cover 110. Both controls 65 and 18 are accessible for operation through aperture in main cover 22.

Upon the occurrence of predetermined fault current conditions the flux generated by current flowing in coil 35 attracts armature 52 to stationary frame 48 causing bifurcated armature bracket 71 to engage enlarged formation 71 on transverse extension 73 of common tripper bar 75. The latter is part of tripper bar means 200 that pivots clockwise about an axis which coincides with axis 62 for adjusting bar 55 which causes screw 76 on tripper bar extension 77 to pivot latch member 78 in a clockwise or tripping direction about its pivot 79, thereby releasing latching point 81 of latch plate 951 on pivot 952 thereby releasing latching point 953 of cradle 80 so that the latter is free to pivot clockwise about pivot 82. As cradle 80 pivots clockwise, end 83 of upper toggle link 84 moves up and to the right with respect to FIG. 4 permitting coiled tension springs 86 connected between toggle knee 87 and manual operating handle 88 to collapse toggle 84, 85 and move handle 88 to the left. The latter is pivoted about center 89 through a connection between handle 88 and its rearward extension 91.

The lower end of lower toggle link 85 is pivotally connected at 92 to the free end of radial extension 93 of contact carrier 90. Thus, as toggle 84, 85 collapses carrier 90 is pivoted clockwise with respect to FIG. 4 and by so doing moves the contact arms 31 of all three poles to the solid line or open circuit position of FIG. 2. It is noted that base 21 is a multipart unit having sections which mate along dividing line 23 so that the reduced diameter bearing portions of contact carrier 90 may be inserted and capture in operative positions. in the closed position of circuit breaker portion 59 an individual torsion spring 94, interposed between carrier 90 and movable contact arm 31, biases arm 31 counterclockwise about insulating rod 99 as a center and thereby generates contact pressure.

For each pole A, B, C an individual parallel plate arc chute 95 is provided to facilitate extinction of arcs drawn between circuit breaker contacts 29, 30 upon separation thereof. Arcing gases exiting from arc chute 95 at the left thereof with respect to FIG. 2 migrate forward as indicated by the dash lines G and are directed by hooded portion 96 of cover 22 to exit through opening 97 and flow to the left with respect to FIG. 2 in front of contactor section 58. External cover barriers 98 serve to prevent direct mixing of arcing gases from different poles at the instant these gases leave housing 21, 22 through exit openings 97.

The electrical and magnetic elements of contactor 58 are generally of conventional construction and include U-shaped magnetic yoke 101 whose arms are surrounded by portions of coil 102. When the latter is energized, armature 103 is attracted to yoke 101 and carries contact carrier 104 rearward. The latter mounts the bridging contacts 41 of all three poles so that contacts 41 move to their closed position wherein movable contacts 40, 42 engage the respective stationary contacts 39, 43. Steel elements 105 mounted to the inside of cover 22 are positioned in the regions of the contactor contacts 39, 40, 43, 43 whereby extinction of arcs drawn between these contacts upon separation thereof is facilitated through magnetic action.

Rivet III (FIG. 2) secures conducting strap 37 on the forward surface of insulating cover 110 of L-shaped cross-section. The latter forms the forward boundary for chamber 112 wherein common tripper bar 75, adjusting bar 55 an armatures 52 are disposed. After the removal of main cover 22, auxiliary cover 110 is removable for access to adjusting scres 63. The rear surface of cover 110 is provided with protrusions 114 which engage and guide movement of extension 73. The latter is flexibly mounted to trip bar 75 at resilient reduced cross-section area 116 which is constructed to bias extension 73 forward.

As seen best in FIGS. 10 through 15, control 18 consists of knob 151 and actuator 152. Each of the elements 151, 152 is of one piece construction being molded of plastic material. Knob 151 includes cylindrical shaft sectin 153 having an annular shoulder 154 at a point intermediate the ends of cylindrical section 153. The forward end of section 153 is provided with slot 155 to receive a screw driver for pivoting control 18. The portion of section 153 to the rear of shoulder 154 is provided with longitudinally extending slot 156. Offset 90° from slot 156 are diametrically opposed outwardly extending tabs 157, 157 whose outer surfaces are slanted so that tabs 157 may be cammed inwardly during mounting of knob 151 to actuator 152, as will hereinafter be apparent. Normally the portion of knob 151 forward of shoulder 154 extends through circular aperture 18b of main cover 22 so that slot 155 is accessible from outside of cover 22.

Actuator 152 includes cylindrical bearing section 161 disposed within aperture 18a of auxiliary cover 110. Section 161 is provided with axial bore 162 that extends rearward from the forward end of actuator 152. Transverse apertures 163 extend outward from bore 162. When the rear end of knob 151 is inserted into bore 162 tabs 157 are initially pressed inward and then snap outward into apertures 163 to connect knob 151 and actuator 152 as a unitary structure. To the rear of bearing section 161, actuator 152 is provided with camming surface 165 and radial projection 166 guide stem 167 extends to the rear of projection 166 into internal guide aperture 168 of base 21. Coiled compression spring 169 surrounds stem 167 and engages the rear of formation 166 to bias control 168 forward.

When main cover 22 is in its normal closed position, as in FIG. 10, the rear surface of cover 22 engages shoulder 154 and depresses control 18 to its inactive position. When cover 22 is open, as in FIG. 11, control 18 is moved forward by the force of spring 169. This brings cam surface 165 into engagement with common trip bar 75 causing the latter to move to the right and pivoting trip bar means 200 clockwise to its tripping position whereby the circuit breaker contacts 29, 30 are opened by mechanism 70.

With main cover 22 closed, radial projection 166 is aligned with trip bar 75. Thus, as control 18 is pivoted counterclockwise with respect to FIG. 1, projection 166 engages trip bar 75 moving the latter from left to right with respect to FIG. 10 to pivot trip bar means 200 in a clockwise direction thereby causing mechanism 70 to open circuit breaker contacts 29, 30.

It is noted that an element identical to knob 151 is utilized as a portion of adjustment control 65.

For more detailed descriptions of certain elements illustrated in the drawings reference is made to one or more of the following co-pending U.S. Pat. application Ser. Nos. 681,243; 681,245; 681,250; 681,253; all filed on even date herewith.

Although a preferred embodiment of this invention has been described, many variations and modifications will now be apparent to those skilled in the art, and it is therfore preferred that the instant invention be limited not by the specific disclosure herein but only by the appending claims.

The embodiments of the invention in which an exclusive privilege or property is claimed are defined as follows:

1. A multipole switching device including a set of cooperating contacts for each pole of said device, an operating mechanism for normally opening and closing said contacts, automatic trip means for operating said mechanism to open said contacts upon the occurrence of predetermined overload conditions; said mechanism including a latch means which when latched permits said mechanism to open and close said contacts; said latch means when unlatched releasing a portion of said mechanism to open said contacts; said automatic trip means including a common trip means for all poles of said device; a housing wherein said contacts, said mechanism and said trip means are disposed; said housing including an openable front cover; a trip actuator; biasing means urging said actuator forward; said actuator being maintained by said cover in a first position when the latter is closed; with said cover open said biasing means operating said actuator forward to a second position; said actuator in moving from said first to said second position operatively engaging said trip means for operation thereof to unlatch said latch means whereby said mechanism opens said contacts; with said cover closed, said actuator being accessible from outside of said housing to operatively engage said trip means for operation thereof to unlatch said latch means whereby said mechanism opens said contacts; said actuator being provided with a first formation that operatively engages the trip means to unlatch the latch when the actuator moves from said first to said second position; said actuator being provided with a second formation which operatively engages the trip means to unlatch the latch when the actuator is operated from outside of said housing when the cover thereof is closed.

2. A multipole switching device as set forth in claim 1 in which the actuator is mounted for movement parallel to a pivot axis in moving between said first and second positions; said actuator when operated from outside the housing being pivoted about said pivot axis.

3. A multipole switching device as set forth in claim 2 in which the first formation is a forwardly facing cam surface and the second formation is an arm projecting radially from the pivot axis.

4. A multipole switching device as set forth in claim 3 in which the actuator includes first and second sections held in operative engagement by snap-fitting of cooperating formations; said first section including said first and second formations and said second section including a tool engageable portion located at an opening in said cover when the latter is closed.

5. A multipole switching device including a set of cooperating contacts for each pole of said device, an operating mechanism for normally opening and closing said contacts, automatic trip means for operating said mechanism to open said contacts upon the occurrence of predetermined overload conditions; said mechanism including a latch means which when latched permits said mechanism to open and close said contacts; said latch means when unlatched releasing a portion of said mechanism to open said contacts; said automatic trip means including a common trip means for all poles of said device; a housing wherein said contacts, said mechanism and said trip means are disposed; said housing including an openable front cover; a trip actuator; biasing means urging said actuator forward; said actuator being maintained by said cover in a first position when the latter is closed; with said cover open said biasing means operating said actuator forward to a second position; said actuator in moving from said first to said second position operatively engaging said trip means for operation thereof to unlatch said latch means whereby said mechanism opens said contacts; with said cover closed, said actuator being accessible from outside of said housing through an opening in said cover for movement of the actuator to operatively engage said trip means for operation thereof to unlatch said latch means whereby said mechanism opens said contacts.

6. A multipole switching device as set forth in claim 5 in which the actuator is mounted for movement parallel to a pivot axis in moving between said first and second positions; said actuator when operated from outside the housing being pivoted about said pivot axis.

* * * * *